United States Patent [19]

Nakayama et al.

[11] Patent Number: 4,945,022

[45] Date of Patent: Jul. 31, 1990

[54] TRIBOELECTRIC CHARGE APPLICATION MEMBER FOR TONER COMPRISING COPOLYMER OF FLUORO-OLEFIN MONOMER AND UNSATURATED SILICON MONOMER

[75] Inventors: Nobuhiro Nakayama, Susono; Yasuo Asahina, Numazu; Hiroyuki Fushimi, Numazu; Yasuaki Iwamoto, Numazu, all of Japan

[73] Assignee: Ricoh Company, Ltd., Tokyo, Japan

[21] Appl. No.: 323,359

[22] Filed: Mar. 14, 1989

Related U.S. Application Data

[62] Division of Ser. No. 163,694, Mar. 3, 1988, Pat. No. 4,841,331.

[51] Int. Cl.[5] ..... G03G 9/08

[52] U.S. Cl. ..... 430/120; 355/255

[58] Field of Search ..... 430/108, 109, 110, 126, 430/120

[56] References Cited

U.S. PATENT DOCUMENTS 4,600,677 7/1986 Hoffend et al. ..... 430/108

4,711,818 12/1987 Henry ..... 428/447

*Primary Examiner*—John L. Goodrow

*Attorney, Agent, or Firm*—Flynn, Thiel, Boutell & Tanis

[57] ABSTRACT

A triboelectric charge application member for imparting or applying electrostatic charge to a toner through the triboelectric charging thereof for developing electrostatic images with the charge toner to visible toner images. The triboelectric charge application member includes an overcoat layer comprising as the main component a polymer which comprises a fluoro-olefin compound and an unsaturated silicon compound as the monomer units of the polymer. The triboelectric charge application member may be carrier particles having the above overcoat layer and a toner transportation member having the overcoat layer, depending upon its application.

22 Claims, 1 Drawing Sheet

TRIBOELECTRIC CHARGE APPLICATION MEMBER FOR TONER COMPRISING COPOLYMER OF FLUORO-OLEFIN MONOMER AND UNSATURATED SILICON MONOMER

This is a division of Ser. No. 163,694, filed Mar. 3, 1988, now U.S. Pat. No. 4,841,331.

BACKGROUND OF THE INVENTION

The present invention relates to a triboelectric charge application member for imparting or applying electrostatic charge to a toner for developing electrostatic images in electrophotography, electrostatic printing and the like, by triboelectric charging of the toner, which triboelectric charge application member here covers not only the carrier particles which impart electrostatic charge to a toner through triboelectrification for use in a two-component type developer, but also a toner transportation member which also impart electrostatic charge to a toner through contact therewith, while regulating the thickness of a toner layer. Examples of such a toner transportation member are a development sleeve and a doctor blade Thus, in this patent application, materials, compositions and members which impart electrostatic charge to toner particles for use in the above-mentioned fields through contact therewith are collectively referred to as the triboelectric charge application member.

Conventionally there are two types of methods of developing latent electrostatic images to visible toner images. In the first development method, a two-component type developer comprising a mixture of toner particles and carrier particles is used, and in the second development method, a one-component type developer consisting of toner particles free from carrier particles is used.

In the first development method, a mixture of toner particles and carrier particles is stirred so that the toner particles are triboelectrically charged to a polarity opposite to the polarity of the carrier particles. Latent electrostatic images are developed by the thus triboelectrically charged toner particles to visible toner images. In such two-component dry-type developers, finely-divided toner particles are electrostatically held on the surface of comparatively large carrier particles. With access of the toner particles to a latent electrostatic image, the toner particles are attracted to adhere to the latent electrostatic image and adhere thereto, so that the latent electrostatic image is developed to a visible toner image. The developer can be used in repetition with replenishment of new toner particles for consumed ones from time to time in the course of the development.

Therefore, it is necessary that the carrier particles be capable of triboelectrically charging toner particles to the desired polarity, with a sufficient charge quantity, and that the charge quantity and the polarity thereof be maintained for a sufficiently long period of time for use in practice. In a conventional developer, however, it is apt to occur that melted toner particles adhere to the surface of the carrier particles, for instance, by collision between the toner and carrier particles or mechanical collision between the toner and carrier particles and the developing apparatus or by the subsequent heat build-up while in use. Once such a phenomenon takes place, which is generally referred to as the "spent phenomenon", the electrostatic characteristics of the carrier particles deteriorate with time, eventually resulting in the necessity for replacement of the entire developer by a new developer.

In order to prevent the spent phenomenon, a variety of methods have been conventionally proposed in which the surface of the carrier particles is coated with a variety of resins. For example, carrier particles are coated with a resin such as styrene-methacrylate copolymer and styrene polymer. Such carrier particles are excellent in the electrostatic charging characteristics. However, since the critical surface energy of the carrier particles is so high that the spent phenomenon cannot be suppressed effectively.

In contrast, carrier particles coated with a tetrafluoroethylene polymer have a low surface energy, so that the spent phenomenon scarcely takes place in the carrier particles; however, the adhesiveness of the tetrafluoroethylene polymer itself is so poor that it is difficult to fix firmly the polymer to the core particle of the carrier. Thus, such tetrafluoroethylene-polymer-coated carrier particles are not suitable for use in practice.

The second development method using a one-component type developer is conventionally known, for example, as disclosed in U.S. Pat. No. 4,196,060 and U.S. Pat. No. 4,160,884. In this development method, a triboelectric charge application member, such as a blade for regulating the thickness of a toner layer, comes into firm contact with the toner particles, and by the heat generated in the course of the firm contact of triboelectric charge application member with the toner particles, the toner particles are apt to be fused and adhere to the charge application member.

SUMMARY OF THE INVENTION

It is therefore an object of the present invention to provide a triboelectric charge application member having an overcoat layer capable of imparting electrostatic charge to toner through triboelectrification for use in the development of latent electrostatic images, with stable charging characteristics and a low critical surface energy, which is particularly capable of preventing the so-called spent phenomenon that a toner adheres in the form of a film to the surface of carrier particles while in use for an extended period of time.

The triboelectric charge application member here has been-defined previously and is substantially the same thing as that defined in U.S. Pat. No. 4,673,631, and may be a composition or a member which comes into contact with toner particles and applies the necessary electric charge through triboelectric charging to the toner particles for developing latent electrostatic images to visible images, or which auxiliarily applies the electric charge to the toner for the same purpose.

Another object of the present invention is to provide a triboelectric charge application member having an overcoat layer which is hardly peeled from the member even when used continuously for an extended period of time, which charge application member is secured to a substrate base member.

A further object of the present invention is to provide a triboelectric charge application member capable of triboelectrically charging toner in a stable manner, without deterioration in the performance, even when used continuously for an extended period of time.

The above objects of the present invention can be achieved by a triboelectric charge application member for triboelectrically charging toner, which comprises a core member, made of a material such as metal, glass, and plastics, and a overcoat layer coated thereon, comprising as the main component a polymer comprising as monomer units a fluoro-olefin compound and an unsaturated silicone compound.

DETAILED DESCRIPTION OF THE PREFERRED EMBODIMENTS

Figure 1:
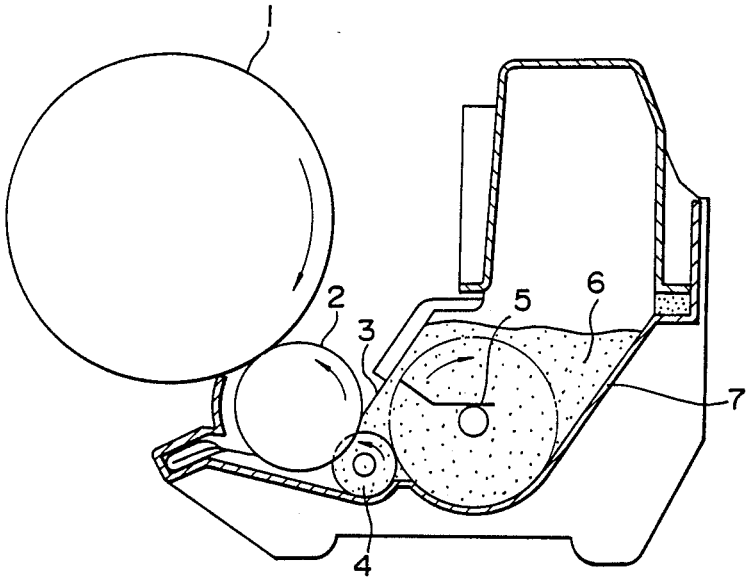
FIG. 1 is a schematic cross-sectional view of a development apparatus for use in the present invention.

It is preferable that the polymer for an overcoat layer be made from a fluoro-olefin compound, vinyl ether and an unsaturated silicon compound. It is particularly preferable that the polymer for the overcoat layer substantially comprise (a) a fluoro-olefin compound, (b) a vinyl ether compound and (c) an organic silicon compound which contains at least an olefin-type unsaturated bond and a hydrolyzable group, with the mole ratios of the fluoro-olefin compound, the vinyl ether compound and the organic silicon compound, respectively, being 30~70 mole %, 20~60 mole % and 1~25%, to the total moles of the three components (a), (b) and (c), and with the number average molecular weight (Mn) of 3,000~200,000 as measured by gel permeation chromatography.

The fluoro-olefin compound which is a monomer component of the polymer for the overcoat layer contains at least one or more fluorine atoms in the molecule. It is preferable that the fluoro-olefin compound be a perhalo-olefin in which all hydrogen atoms thereof are substituted by fluorine atoms and other halogen atoms. Furthermore, from the viewpoint of the polymerizability and the properties of the produced polymer, it is preferable the fluoro-olefin have 2 or 3 carbon atoms.

Examples of such a fluoro-olefin compound are (i) a fluoroethylene, (ii) a fluoropropene, and (iii) a fluoroolefin having not more than 4 carbon atoms.

(i) Specific examples of a fluoroethylene are:

| | | | |
|---|---|---|---|
| $CF_2{=}CF_2$, | $CHF{=}CF_2$, | $CH_2{=}CF_2$, | $CH_2{=}CHF$, |
| $CClF{=}CF_2$, | $CHCl{=}CF_2$, | $CCl_2{=}CF_2$, | $CClF{=}CClF$, |
| $CHF{=}CCl_2$, | $CH_2{=}CClF$, | $CCl_2{=}CClF$. | |

(ii) Specific examples of a fluoropropene are:

| | | | |
|---|---|---|---|
| $CF_3CF{=}CF_2$, | $CF_3CF{=}CHF$, | $CF_3CH{=}CF_2$, | $CF_3CF{=}CH_2$, |
| $CHF_2CF{=}CHF$, | $CF_3CH{=}CH_2$, | $CH_3CF{=}CF_2$, | $CH_3CH{=}CF_2$, |
| $CH_3CF{=}CH_2$, | $CF_2ClCF{=}CF_2$, | $CF_3CCl{=}CF_2$, | $CF_3CF{=}CFCl$, |
| $CF_2ClCCl{=}CF_2$, | $CF_2ClCF{=}CFCl$, | $CFCl_2CF{=}CF_2$, | $CF_3CCl{=}CClF$, |
| $CF_3CCl{=}CCl_2$, | $CClF_2CF{=}CCl_2$, | $CCl_3CF{=}CF_2$, | $CF_2ClCCl{=}CCl_2$, |
| $CFCl_2CCl{=}CCl_2$, | $CF_3CF{=}CHCl$, | $CClF_2CF{=}CHCl$, | $CF_3CCl{=}CHCl$, |
| $CHF_2CCl{=}CCl_2$, | $CF_2ClCH{=}CCl_2$, | $CF_2ClCCl{=}CHCl$, | $CCl_3CF{=}CHCl$, |
| $CF_2ClCF{=}CF_2$, | $CF_2BrCH{=}CF_2$, | $CF_3CBr{=}CHBr$, | $CF_2ClCBr{=}CH_2$, |
| $CH_2BrCF{=}CCl_2$, | $CF_3CBr{=}CH_2$, | $CF_3CH{=}CHBr$, | $CF_2BrCH{=}CHF$, |
| $CF_2BrCF{=}CF_2$. | | | |

(iii) Specific examples of a fluoro-olefin having not more than 4 carbon atoms are:

| | | | |
|---|---|---|---|
| $CF_3CF_2CF{=}CF_2$, | $CF_3CF{=}CFCF_3$, | $CF_3CH{=}CFCF_3$, | $CF_2{=}CFCF_2CHF_2$, |
| $CF_3CF_2CF{=}CH_2$, | $CF_3CH{=}CHCF_3$, | $CF_2{=}CFCF_2CH_3$, | $CF_2{=}CFCH_2CH_3$, |
| $CF_3CH_2CH{=}CH_2$, | $CF_3CH{=}CHCH_3$, | $CF_2{=}CHCH_2CH_3$, | $CH_3CF_2CH{=}CH_2$, |
| $CFH_2CH{=}CHCFH_2$, | $CH_3CF_2CH{=}CH_2$, | $CH_2{=}CFCH_2CH_3$, | |
| $CF_3(CF_2)_2CF{=}CF_2$, | $CF_3(CF_2)_3CF{=}CF_2$. | | |

Among the above, fluoroethylenes and fluoro-propenes are preferable for use. In particular, tetrafluoroethylene ($CF_2{=}CF_2$), chlorotrifluoroethylene ($CFCl{=}CF_2$) and hexafluoropropene ($CF_2{=}CFCF_3$) are more preferable for use. Furthermore, from the viewpoint of safety and the ease of handling, hexafluoropropene and chlorotrifluoroethylene are suitable for use in practice.

In the present invention, the fluoro-olefin compounds can be used individually or in combination.

Vinyl ethers are compounds in which vinyl groups are bonded through an ether bond, or a vinyl group and any of an alkyl (including cycloalkyl) group, an aryl group, and an aralkyl group are bonded to each other through an ether bond, particularly alkyl vinyl ethers having 8 or less carbon atoms, preferably alkyl vinyl ethers bonded to alkyl groups having 2 to 4 carbon atoms, are suitable for use in the present invention. Alkyl vinyl ethers having chain alkyl groups are most preferable for use.

Examples of such vinyl ethers are chain alkyl vinyl ethers such as ethyl vinyl ether, propyl vinyl ether, isopropyl vinyl ether, butyl vinyl ether, tert-butyl vinyl ether, pentyl vinyl ether, hexyl vinyl ether, isohexyl vinyl ether, octyl vinyl ether, 4-methyl-1-pentyl vinyl ether; cycloalkyl vinyl ethers such as cyclopentyl vinyl ether and cyclohexyl vinyl ether; aryl vinyl ethers such as phenyl vinyl ether, o-, m-, p-trivinyl ethers; aralkyl vinyl ethers such as benzyl vinyl ether and phenethyl vinyl ether.

Of the above vinyl ethers, chain alkyl vinyl ethers and cycloalkyl vinyl ethers are particularly preferable, and ethyl vinyl ether, propyl vinyl ether and butyl vinyl ether are most suitable for use in the present invention.

In the present invention, the vinyl ethers can be used alone or in combination.

The organic silicon compounds can be employed as long as they have olefin unsaturated bonds and hydrolyzable groups therein. Specific examples of the organic silicon compounds are those having the following general formulas (1) through (3):

(1) $R^1R^2SiY^1Y^2$ (2) $R^1XSiY^1Y^2$ (3) $R^1SiY^1Y^2Y^3$ wherein $R^1$ and $R^2$ each represent a group including an olefinic unsaturated bond comprising carbon atoms and hydrogen atoms, and optionally oxygen atoms, $R^1$ and $R^2$ may be the same or different, X represents an organic group having no olefinic unsaturated bond, and $Y^1$, $Y^2$ and $Y^3$ each represent a hydrolyzable group, which may be the same or different.

Specific examples of $R^1$ and $R^2$ are vinyl, allyl, butynyl, cyclohexenyl and cyclopentadienyl groups. Particularly groups including an olefinic unsaturated moiety at the terminal thereof are preferable for use. As other preferable examples, those having an ester bond of unsaturated acids at the terminal thereof are preferable for use in the present invention.

$CH_2{=}CH{-}O{-}(CH_2)_3{-}$, $CH_2{=}C(CH_3)COO(CH_2)_2{-}O{-}(CH_2)_3{-}$, $CH_2{=}C(CH_3)COOCH_2CH_2OCH_2CHCH_2O(CH_2)_3{-}$, $$CH_2{=}C(CH_3)COOCH_2CH_2OCH_2\underset{\underset{OH}{|}}{C}HCH_2O(CH_2)_3{-},$$

Of the above groups, vinyl group is most suitable. Specific examples of X are monovalent hydrocarbon groups such as methyl, ethyl, propyl, tetradecyl, octadecyl, phenyl, benzyl, tolyl, and halogen-substituted hydrocarbon groups.

Specific examples of $Y^1$, $Y^2$ and $Y^3$ are alkoxy groups such as methoxy, ethoxy, butoxy, methoxyethoxy; alkoxyalkoxy groups; acyloxy groups such as formyloxy, acetoxy, and propionoxy; oximes such as $-ON{=}C(CH_3)_2$, $-ON{=}CHCH_2C_2H_5$ and $-ON{=}C(C_6H_5)H_2$; substituted amino groups and aryl amino groups, such as $-NHCH_3$, $-NHC_3H_5$ and $-NH(C_6H_5)$, and any other hydrolyzable organic groups.

Preferable organic silicon compounds for use in the present invention are, for example, vinyloxy propyl trimethoxy silane, vinyl trimethoxy silane, vinyl triethoxy silane, vinyl tris(methoxy ethoxy) silane, vinyl methyl diethoxy silane, and vinyl phenyl dimethoxy silane.

Fluorine polymers can be prepared by copolymerization any of the monomers (a)~(c) mentioned above in the presence of a conventional radical initiator.

As such an initiator for the copolymerization, conventional initiators, such as benzoyl peroxide, dichlorobenzoyl peroxide, and dicumyl peroxide, can be employed.

The copolymerization is carried out in a reaction medium comprising an organic solvent. Examples of the organic solvent for this purpose are aromatic hydrocarbons such as benzene, toluene, xylene; aliphatic hydrocarbons such as n-hexane, cyclohexane, and n-heptane; halogenated aromatic hydrocarbons such as chlorobenzene, bromobenzene, iodobenzene, and o-bromotoluene; and halogenated aliphatic hydrocarbons such as tetrachloromethane, 1,1,1-trichloroethane, tetrachloroethylene, and 1-chlorobutane.

The copolymerization is carried out by adding a radical initiator to any of the foregoing solvents in the range of $10^{-2}\sim2\times10^{-3}$ in terms of the mole ratio to the total mole number of the monomers.

The copolymerization is performed at the temperatures of $-30\sim200°$ C., preferably $20\sim100°$ C., under a polymerization pressure of $0\sim100$ kg/cm$^2$-G, preferably $0\sim50$ kg/cm$^2$-G.

In order to improve the adhesiveness of the polymer when using the polymer as an overcoat material for a core substrate member, it is preferable to add a metal chelate compound to the polymer. For this purpose, any conventional metal chelate compounds can be employed in principle. As the central metals for the formation of the chelate compounds, for example, Ti, Al, Zr, Co, and Mn can be employed. Such metal chelate compounds are readily obtained by reacting the alkoxides of the foregoing metals with a chelating agent. Examples of the chelating agents are $\beta$-diketones such as acetyl acetone and 2,4-heptanedione; ketoesters such as acetomethyl acetate, acetoethyl acetate, and acetobutyl acetate; hydroxy carbonic acids or esters or salts thereof, such as lactic acid, salicylic acid, malic acid, tartaric acid, methyl lactate, ethyl lactate, ethyl salicylate, phenyl salicylate, ethyl malate, methyl tartrate, and ethyl tartrate, and ammonium lactate; ketone alcohols such as 4-hydroxy-4-methyl-2-pentanone, 4-hydroxy-2-pentanone, 4-hydroxy-2-heptanone, and 4-hydroxy-4-methyl-2-heptanone; amino alcohols such as monoethanol amine, diethanol amine, N-methyl monoethanol amine, N-ethyl monoethanol amine, N,N-dimethyl ethanol amine, and N,N-diethyl ethanol amine; and enol-type active hydrogen compounds such as diethyl malonate, methylol melamine, methylol urea, and methylol acrylamide.

It is preferable that the weight ratio of the metal chelate compound to the fluorine polymer be (1~70) : (100), more preferably (3~60) : 100. If the ratio is too low, the adhesiveness is not improved; on the other hand, if the ratio is too high, the overcoat layer becomes brittle.

Organic solvents for use in the overcoating are, for example, aromatic hydrocarbons such as benzene, toluene, and xylene; ketones such as acetone, and methyl ethyl ketone; ethers such as diethyl ether, and dipropyl ether; alcohols such as ethanol; halogenated hydrocarbons such as trichloromethane, dichloroethane, and chlorobenzene.

An intermediate layer may be interposed between the core substrate member and the coating layer.

The overcoat layer can be formed by coating the core particles with an overcoat layer coating liquid containing any of the above-mentioned copolymers for use in the present invention by use of a conventional method, such as the fluidized bed coating method, the spray coating method, and the dip coating method.

To the overcoat layer, any of the following materials may be added: Metal oxides such as silicon oxide, aluminum oxide, titanium oxide, tin oxide, antimony oxide; various kinds of carbon black such as channel black, furnace black, porous carbon, lamp black, and acetylene black; and other materials such as boron nitride, titanium black, silicon carbide, and boron carbide.

Toner particles to be used together with the foregoing carrier particles are prepared by conventional processes.

Examples of a resin for use the toner particles are styrene resin, acrylic resin, epoxy resin, and polyester resin. Examples of a colorant for use in the toner particles are carbon black and Hensa Yellow.

The present invention will now be explained in detail with reference to the following examples.

EXAMPLE 1

[Preparation of Coated Carrier Particles]

A mixture of the following components was dispersed to prepare an overcoat layer coating liquid:

| | Parts by Weight |
|---|---|
| Hexafluoropropene/ethyl vinyl ether/trimethoxy vinyl silane copolymer (weight ratio 64:24:12, number-average molecular weight approx. 8000) | 100 |
| 70% butanol solution of dibutoxy titanium bisoctylene glycolate | 10 |
| Toluene | 800 |

The above prepared overcoat coating liquid was coated on the surface of spherical iron oxide particles having a particle size of 100 μm in an amount of 5000 parts by weight by use of a fluidized bed coating applicator. The coated overcoating liquid was then heated at 100° C. for 2 hours, whereby coated carrier particles were obtained.

[Preparation of Toner]

A mixture of the following components was fused in a roll mill at 120~130° C. for about 30 minutes, whereby toner particles were prepared:

| | Parts by Weight |
|---|---|
| Styrene acrylic resin (Trademark "RSB700" made by Sanyo Chemical Industries, Ltd.) | 87 |
| Carbon black (Trademark "Mogal L" made by Cabot Corp.) | 12 |
| Nigrosine dye (Trademark "Nigrosine Base EX" made by Oriental Chemical Industries, Ltd.) | 0.5 |

100 parts by weight of the above prepared carrier particles and 2.5 parts by weight of the toner particles were mixed, whereby a developer was prepared.

The thus prepared developer was subjected to the following image formation tests using a modified commercially available copying machine (Trademark "FT-4060" made by Ricoh Company, Ltd.), with incorporation of an organic photoconductor comprising (i) a carrier transport layer (CTL) comprising a hydrazone type charge transporting agent and polycarbonate and (ii) a carrier generation layer (CGL) comprising a bisazo type charge generating agent and polyvinyl butyral:

A latent electrostatic image having a negative polarity was formed on the above-mentioned organic photoconductor and the latent electrostatic image was developed to a visible toner image with the above prepared developer and the toner image was transferred to a transfer sheet. This process was repeated 100,000 times at a rate of 30 times/min (making 30 copies/min), with the developer replenished from time to time in the course of the tests.

The initial charge quantity of the toner was measured by the flow-off method. The initial charge quantity was +20 μC/g. After repeating the above-mentioned copy making process 100,000 times, the charge quantity of the toner was 18 μC/g, which was almost the same as the initial charge quantity of the toner.

After repeating the above process 100,000 times, the toner particles were observed by an electron microscopy. The result was that there was no peeling of the overcoat layer off the core particles.

COMPARATIVE EXAMPLE 1

[Preparation of Comparative Coated Carrier Particles]

A mixture of the following components was dispersed to prepare an overcoat layer coating liquid:

| | Parts by Weight |
|---|---|
| Teflon S (made by Du Pont de Nemours, E. I. & Co.) | 1000 |
| Water | 1000 |

The above prepared overcoat coating liquid was coated on the surface of spherical iron oxide particles having a particle size of 100 μm in an amount of 5000 parts by weight by use of a fluidized bed coating applicator. The coated overcoating liquid was then heated at 300° C. for 2 hours, whereby comparative coated carrier particles were prepared.

100 parts by weight of the above prepared comparative carrier particles and 2.5 parts by weight of the toner particles prepared in Example 1 were mixed, so that a comparative developer was prepared. The thus prepared comparative developer was subjected to the same image formation tests as in Example 1. The result was that the initial charge quantity of the toner was +22 μC/g, and the charge quantity after repeating the copy making process 30,000 times decreased to +12 μC/g.

An observation by an electron microscopy of the carrier particles after repeating the copy making process 30,000 times indicated that there was peeling of the overcoat layer from the core particles.

EXAMPLE 2

[Preparation of Coated Carrier Particles]

A mixture cf the following components was dispersed to prepare an overcoat layer coating liquid:

| | Parts by Weight |
|---|---|
| Chlorotrifluoroethylene/propylvinyl ether/vinyltrimethoxy silane copolymer (weight ratio 55:35:10, number-average molecular weight approx. 12000) | 100 |
| 75% isopropenol solution of diisopropoxy titanium acetyl acetonate | 20 |
| Toluene | 800 |

The above prepared overcoat coating liquid was coated on the surface of spherical iron oxide particles having a particle size of 100 μm in an amount of 5000 parts by weight by use of a fluidized bed coating applicator. The coated overcoating liquid was then heated at 100° C. for 2 hours as in Example 1, whereby coated carrier particles were obtained.

100 parts by weight of the above prepared carrier particles and 2.5 parts by weight of the toner particles prepared in Example 1 were mixed, so that a developer was prepared. The thus prepared developer was subjected to the same image formation tests as in Example 1. The result was that clear images were obtained even after repeating the copy making process 100,000 times.

The initial charge quantity of the toner was +18 μC/g, and the charge quantity after repeating the copy making process 100,000 times was +16 μC/g, which was almost the same as the initial charge quantity.

An observation by an electron microscopy of the carrier particles after repeating the copy making process 100,000 times indicated that there was no peeling of the overcoat layer from the core particles.

EXAMPLE 3

[Preparation of Coated Carrier Particles]

A mixture of the following components was dispersed to prepare an overcoat layer coating liquid:

| | Parts by Weight |
|---|---|
| Chlorotrifluoroethylene/propylvinyl ether/vinyltrimethoxy silane copolymer (weight ratio 55:35:10, number-average molecular weight approx. 12000) | 100 |
| Toluene | 800 |

The above prepared overcoat coating liquid was coated on the surface of spherical iron oxide particles having a particle size of 100 μm in an amount of 5000 parts by weight by use of a fluidized bed coating applicator. The coated overcoating liquid was then heated at 100° C. for 2 hours as in Example 1, whereby coated carrier particles were obtained.

100 parts by weight of the above prepared carrier particles and 2.5 parts by weight of the toner particles prepared in Example 1 were mixed, so that a developer was prepared. The thus prepared developer was subjected to the same image formation tests as in Example 1. The result was that clear images were obtained even after repeating the copy making process 100,000 times.

The initial charge quantity of the toner was +20 μC/g, and the charge quantity after repeating the copy making process 100,000 times was +17 μC/g, which was almost the same as the initial charge quantity An observation by an electron microscopy of the carrier particles after repeating the copy making process 100,000 times indicated that there was no peeling of the overcoat layer from the core particles.

EXAMPLE 4

[Preparation of Coated Carrier Particles]

A mixture of the following components was dispersed to prepare an overcoat layer coating liquid:

| | Parts by Weight |
|---|---|
| Hexafluoropropene/ethyl vinyl ether/trimethoxy vinyl silane copolymer (weight ratio 64:24:12, number-average molecular molecular weight approx. 8000) | 100 |
| Toluene | 800 |

The above prepared overcoat coating liquid was coated on the surface of spherical iron oxide particles having a particle size of 100 μm in an amount of 5000 parts by weight by use of a fluidized bed coating applicator. The coated overcoating liquid was then heated at 100° C. for 2 hours as in Example 1, whereby coated carrier particles were obtained.

100 parts by weight of the above prepared carrier particles and 2.5 parts by weight of the toner particles prepared in Example 1 were mixed, so that a developer was prepared. The thus prepared developer was subjected to the same image formation tests as in Example 1. The result was that clear images were obtained even after repeating the copy making process 100,000 times.

The initial charge quantity of the toner was +19 μC/g, and the charge quantity after repeating the copy making process 100,000 times was +16 μC/g, which was almost the same as the initial charge quantity.

An observation by an electron microscopy of the carrier particles after repeating the copy making process 100,000 times indicated that there was no peeling of the overcoat layer from the core particles.

EXAMPLE 5

[Preparation of Coated Carrier Particles]

A mixture of the following components was dispersed to prepare an overcoat layer coating liquid:

| | Parts by Weight |
|---|---|
| Chlorotrifluoroethylene/propylvinyl ether/vinyltrimethoxy silane copolymer (weight ratio 55:35:10, number-average molecular weight approx. 12000) | 100 |
| 75% isopropenol solution of diisopropoxy titanium acetyl acetonate | 20 |
| Toluene | 800 |

The above prepared overcoat coating liquid was coated on the surface of spherical iron oxide particles having a particle size of 100 μm in an amount of 5000 parts by weight by use of a fluidized bed coating applicator. The coated overcoating liquid was then heated at 100° C. for 2 hours as in Example 1, whereby coated carrier particles were obtained.

[Preparation of Toner]

A mixture of the following components was kneaded, pulverized, and classified, whereby green toner particles having a particle size of 5~20 μm were prepared:

| | Parts by Weight |
|---|---|
| Epoxy resin | 100 |
| Polypropylene | 5 |
| C.I. Pigment Blue 15 | 2 |
| C.I. Pigment Yellow 17 | 5 |
| Charge control agent (quaternary ammonium salt) | 0.5 |

100 parts by weight of the above prepared carrier particles and 2.5 parts by weight of the toner particles were mixed in the same manner as in Example 1, so that a developer was prepared.

The thus prepared developer was subjected to the same image formation tests as in Example 1. The result was that clear images were obtained even after repeating the copy making process 100,000 times.

The initial charge quantity of the toner was +18 μC/g, and the charge quantity after repeating the copy making process 100,000 times was +16 μC/g, which was almost the same as the initial charge quantity.

An observation by an electron microscopy of the carrier particles after repeating the copy making process 100,000 times indicated there was no peeling of the overcoat layer from the core particles.

EXAMPLE 6

[Preparation of Coated Carrier Particles]

A mixture of the following components was mixed and dispersed in a homogenizer at 8000 rpm for 20 minutes, so that an overcoat layer coating liquid was prepared:

| | Parts by Weight |
|---|---|
| Hexafluoropropene/ethyl vinyl ether/trimethoxy vinyl silane copolymer (weight ratio 64:24:12, number-average molecular molecular weight approx. 8000) | 100 |
| 70% butanol solution of dibutoxy titanium bisoctylene glycolate | 10 |
| Toluene | 800 |
| Carbon black (Trademark "Denka Black" made by Denki Kagaku Kogyo K.K.) | 5 |

The above prepared overcoat coating liquid was coated on the surface of spherical iron oxide particles having a particle size of 100 μm in an amount of 5000 parts by weight by use of a fluidized bed coating applicator. The coated overcoating liquid was then heated at 100° C. for 2 hours as in Example 1, whereby coated carrier particles were obtained.

100 parts by weight of the above prepared carrier particles and 2.5 parts by weight of the toner particles prepared in Example 1 were mixed, so that a developer was prepared. The thus prepared developer was subjected to the same image formation tests as in Example 1. The result was that clear images were obtained even after repeating the copy making process 100,000 times.

The initial charge quantity of the toner was +18 μC/g, and the charge quantity after repeating the copy making process 100,000 times was +16 μC/g, which was almost the same as the initial charge quantity.

An observation by an electron microscopy of the carrier particles after repeating the copy making process 100,000 times indicated that there was no peeling of the overcoat layer from the core particles.

The copy images obtained by this developer were better in halftone reproduction than the images obtained by the developer prepared in Example 1.

EXAMPLE 7

[Preparation of Coated Carrier Particles]

A mixture of the following components was mixed and dispersed in a homogenizer at 8000 rpm for 20 minutes, so that an overcoat layer coating liquid was prepared:

| | Parts by Weight |
|---|---|
| Hexafluoropropene/ethyl vinyl ether/trimethoxy vinyl silane copolymer (weight ratio 64:24:12, number-average molecular weight approx. 8000) | 100 |
| Toluene | 800 |
| Carbon black (Trademark "Denka Black" made by Denki Kagaku Kogyo K.K.) | 5 |

The above prepared overcoat coating liquid was coated on the surface of spherical iron oxide particles having a particle size of 100 μm in an amount of 5000 parts by weight by use of a fluidized bed coating applicator. The coated overcoating liquid was then heated at 100° C. for 2 hours as in Example 1, whereby coated carrier particles were obtained.

100 parts by weight of the above prepared carrier particles and 2.5 parts by weight of the toner particles prepared in Example 1 were mixed, so that a developer was prepared. The thus prepared developer was subjected to the same image formation tests as in Example 1. The result was that clear images were obtained even after repeating the copy making process 100,000 times.

The initial charge quantity of the toner was +18 μC/g, and the charge quantity after repeating the copy making process 100,000 times was +16 μC/g, which was almost the same as the initial charge quantity.

An observation by an electron microscopy of the carrier particles after repeating the copy making process 100,000 times indicated that there was no peeling of the overcoat layer from the core particles.

The copy images obtained by this developer were better in halftone reproduction than the images obtained by the developer prepared in Example 4.

EXAMPLE 8

[Preparation of Coated Carrier Particles]

A mixture of the following components was mixed and dispersed in a homogenizer at 8000 rpm for 20 minutes, so that an overcoat layer coating liquid was prepared:

| | Parts by Weight |
|---|---|
| Hexafluoropropene/ethyl vinyl ether/trimethoxy vinyl silane copolymer (weight ratio 64:24:12, number-average molecular weight approx. 8000) | 100 |
| 70% butanol solution of dibutoxy titanium bisoctylene glycolate | 10 |
| Toluene | 800 |
| Silicon oxide A200 (Aerozil) | 5 |

100 parts by weight of the above prepared carrier particles and 2.5 parts by weight of the toner particles prepared in Example 1 were mixed, so that a developer was prepared. The thus prepared developer was subjected to the same image formation tests as in Example 1. The result was that clear images were obtained even after repeating the copy making process 100,000 times.

The initial charge quantity of the toner was +18 μC/g, and the charge quantity after repeating the copy making process 100,000 times was +16 μC/g, which was almost the same as the initial charge quantity.

An observation by an electron microscopy of the carrier particles after repeating the copy making process 100,000 times indicated that there was no peeling of the overcoat layer from the core particles.

The thickness of the overcoat layer of the above coated carrier particles was compared with the thickness of the overcoat layer of the coated carrier particles employed in Example 1 by using cross-sectional electron microscopic photographs of the two overcoat layers. The thickness of the overcoat layer of the carrier particles in Example 1 was 2.5 μm before use, while the thickness was decreased to 1.5 μm after the use of the carrier particles 100,000 times in the image formation tests. In sharp contrast to this, the thickness of the overcoat layer of the carrier particles in Example 8 was 2.4 μm before use, while the thickness was 2.0 μm after the use of the carrier particles 100,000 times in the image formation tests, indicating that the abrasion of the overcoat layer of the carrier particles in this example was much less than that of the overcoat layer of the carrier particles in Example 1.

EXAMPLE 9

Preparation of Coated Carrier Particles]

A mixture of the following components was mixed and dispersed in a homogenizer at 8000 rpm for 20 minutes, whereby an overcoat layer coating liquid was prepared:

| | Parts by Weight |
|---|---|
| Chlorotrifluoroethylene/propylvinyl ether/vinyltrimethoxy silane copolymer (weight ratio 55:35:10, number-average molecular weight approx. 12000) | 100 |
| 75% isopropenol solution of diisopropoxy titanium acetyl acetonate | 10 |
| Toluene | 800 |
| Silicon oxide A200 (Aerozil) | 5 |

100 parts by weight of the above prepared carrier particles and 2.5 parts by weight of the toner particles prepared in Example 1 were mixed, so that a developer was prepared. The thus prepared developer was subjected to the same image formation as in Example 1. The result was that clear images were obtained even after repeating the copy making process 100,000 times.

The initial charge quantity of the toner was +19 μC/g, and the charge quantity after repeating the copy making process 100,000 times was +15 μC/g, which was almost the same as the initial charge quantity.

An observation by an electron microscopy of the carrier particles after repeating the copy making process 100,000 times indicated that there was no peeling of the overcoat layer from the core particles.

The thickness of the overcoat layer of the above coated carrier particles was compared with the thickness of the overcoat layer of the coated carrier particles employed in Example 2 by using cross-sectional electron microscopic photographs of the two overcoat layers. The thickness of the overcoat layer of the carrier particles in Example 2 was 2.2 μm before use, while the thickness was decreased to 1.4 μm after the use of the carrier particles 100,000 times in the image formation tests. In sharp contrast to this, the thickness of the overcoat layer of the carrier particles in Example 9 was 2.2 μm before use, while after the use thereof 100,000 times, the thickness was 1.9 μm, indicating that the abrasion of the overcoat layer of the carrier particles in this example was less than that of the overcoat layer of the carrier particles in Example 2.

EXAMPLE 10

[Preparation of Coated Carrier Particles]

A mixture of the following components was mixed and dispersed in a homogenizer at 8000 rpm for 20 minutes, whereby an overcoat layer coating liquid was prepared:

| | Parts by Weight |
|---|---|
| Hexafluoropropene/ethyl vinyl ether/trimethoxy vinyl silane copolymer (weight ratio 64:24:12, number-average molecular weight approx. 8000) | 100 |

-continued

| | Parts by Weight |
|---|---|
| 70% butanol solution of dibutoxy titanium bisoctylene glycolate | 10 |
| Toluene | 800 |
| Titanium black | 5 |

The above prepared overcoat coating liquid was coated on the surface of spherical iron oxide particles having a particle size of 100 μm in an amount of 5000 parts by weight by use of a fluidized bed coating applicator. The coated overcoating liquid was then heated at 100° C. for 2 hours as in Example 1, whereby coated carrier particles were obtained.

100 parts by weight of the above prepared carrier particles and 2.5 parts by weight of the toner particles prepared in Example 1 were mixed, so that a developer was prepared. The thus prepared developer was subjected to the same image formation tests as in Example 1. The result was that clear images were obtained even after repeating the copy making process 100,000 times.

The initial charge quantity of the toner was +17 μC/g, and the charge quantity after repeating the copy making process 100,000 times was +14 μC/g, which was almost the same as the initial charge quantity.

An observation by an electron microscopy of the carrier particles after repeating the copy making process 100,000 times indicated that there was no peeling of the overcoat layer from the core particles.

The copy images obtained by the above developer were better in halftone reproduction than the images obtained by the developer employed in Example 1.

EXAMPLE 11

[Preparation of Coated Carrier Particles]

A mixture of the following components was mixed and dispersed in a homogenizer at 8000 rpm for 20 minutes, whereby an overcoat layer coating liquid was prepared:

| | Parts by Weight |
|---|---|
| Hexafluoropropene/ethyl vinyl ether/trimethoxy vinyl silane copolymer (weight ratio 64:24:12, number-average molecular weight approx. 8000) | 100 |
| 70% butanol solution of dibutoxy titanium bisoctylene glycolate | 10 |
| Toluene | 800 |
| Porous carbon | 5 |

The above prepared overcoat coating liquid was coated on the surface of spherical iron oxide particles having a particle size of 100 μm in an amount of 5000 parts by weight by use of a fluidized bed coating applicator. The coated overcoating liquid was then heated at 100° C. for 2 hours as in Example 1, whereby coated carrier particles were obtained.

100 parts by weight of the above prepared carrier particles and 2.5 parts by weight of the toner particles prepared in Example 1 were mixed, so that a developer was prepared. The thus prepared developer was subjected to the same image formation tests as in Example 1. The result was that clear images were obtained even after repeating the copy making process 100,000 times.

The initial charge quantity of the toner was +19 μC/g, and the charge quantity after repeating the copy making process 100,000 times was +17 μC/g, which was almost the same as the initial charge quantity.

An observation by an electron microscopy of the carrier particles after repeating the copy making process 100,000 times indicated that there was no peeling of the overcoat layer from the core particles.

The copy images obtained by the above developer were better in halftone reproduction than the images obtained by the developer employed in Example 1.

EXAMPLE 12

[Preparation of Coated Carrier Particles]

A mixture of the following components was mixed and dispersed in a homogenizer at 8000 rpm for 20 minutes, whereby an overcoat layer coating liquid was prepared:

| | Parts by Weight |
|---|---|
| Hexafluoropropene/ethyl vinyl ether/trimethoxy vinyl silane copolymer (weight ratio 64:24:12, number-average molecular weight approx. 8000) | 100 |
| 70% butanol solution of dibutoxy titanium bisoctylene glycolate | 10 |
| Toluene | 800 |
| Tin oxide | 5 |

The above prepared overcoat coating liquid was coated on the surface of spherical iron oxide particles having a particle size of 100 μm in an amount of 5000 parts by weight by use of a fluidized bed coating applicator. The coated overcoating liquid was then heated at 100° C. for 2 hours as in Example 1, whereby coated carrier particles were obtained.

100 parts by weight of the above prepared carrier particles and 2.5 parts by weight of the toner particles prepared in Example 1 were mixed, so that a developer was prepared. The thus prepared developer was subjected to the same image formation tests as in Example 1. The result was that clear images were obtained even after repeating the copy making process 100,000 times.

The initial charge quantity of the toner was +16 μC/g, and the charge quantity after repeating the copy making process 100,000 times was +14 μC/g, which was almost the same as the initial charge quantity.

An observation by an electron microscopy of the carrier particles after repeating the copy making process 100,000 times indicated there was no peeling of the overcoat layer off the core particles.

The copy images obtained by the above developer were better in halftone reproduction than the images obtained by the developer employed in Example 1.

EXAMPLE 13

[Preparation of Coated Carrier Particles]

A mixture of the following components was mixed and dispersed in a homogenizer at 8000 rpm for 20 minutes, whereby an overcoat layer coating layer liquid was prepared:

| | Parts by Weight |
|---|---|
| Hexafluoropropene/ethyl vinyl ether/trimethoxy vinyl silane copolymer (weight ratio 64:24:12, number-average molecular weight approx. 8000) | 100 |

-continued

| | Parts by Weight |
|---|---|
| 70% butanol solution of dibutoxy titanium bisoctylene glycolate | 10 |
| Toluene | 800 |
| Titanium oxide | 5 |

The above prepared overcoat coating liquid was coated on the surface of spherical iron oxide particles having a particle size of 100 μm in an amount of 5000 parts by weight by use of a fluidized bed coating applicator. The coated overcoating liquid was then heated at 100° C. for 2 hours as in Example 1, whereby coated carrier particles were obtained.

100 parts by weight of the above prepared carrier particles and 2.5 parts by weight of the toner particles prepared in Example 1 were mixed, so that a developer was prepared. The thus prepared developer was subjected to the same image formation tests as in Example 1. The result was that clear images were obtained even after repeating the copy making process 100,000 times.

The initial charge quantity of the toner was +17 μC/g, and the charge quantity after repeating the copy making process 100,000 times was +15 μC/g, which was almost the same as the initial charge quantity.

An observation by an electron microscopy of the carrier particles after repeating the copy making process 100,000 times indicated that there was no peeling of the overcoat layer from the core particles.

The thickness of the overcoat layer of the above coated carrier particles was compared with the thickness of the overcoat layer of the coated carrier particles employed in Example 1 by using cross-sectional electron microscopic photographs of the two overcoat layers. The thickness of the overcoat layer of the carrier particles in Example 1 was 2.5 μm before use, while the thickness was decreased to 1.5 μm after the use of the carrier particles 100,000 times in the image formation tests. In contrast to this, the thickness of the overcoat layer of the carrier particles in Example 13 was 2.6 μm before use, while the thickness was 2.2 μm after the use of the carrier particles 100,000 times in the image formation tests, thus the abrasion of the overcoat layer of the carrier particles in this example was less than that of the overcoat layer of the carrier particles in Example 1.

EXAMPLE 14

[Preparation of Coated Carrier Particles]

A mixture of the following components was mixed and dispersed in a homogenizer at 8000 rpm for 20 minutes, whereby an overcoat layer coating liquid was prepared:

| | Parts by Weight |
|---|---|
| Hexafluoropropene/ethyl vinyl ether/trimethoxy vinyl silane copolymer (weight ratio 64:24:12, number-average molecular weight approx. 8000) | 100 |
| 70% butanol solution of dibutoxy titanium bisoctylene glycolate | 10 |
| Toluene | 800 |
| Aluminum oxide | 5 |

The above prepared overcoat coating liquid was coated on the surface of spherical iron oxide particles having a particle size of 100 μm in an amount of 5000 parts by weight by use of a fluidized bed coating applicator. The coated overcoating liquid was then heated at 100° C. for 2 hours as in Example 1, whereby coated carrier particles were obtained.

100 parts by weight of the above prepared carrier particles and 2.5 parts by weight of the toner particles prepared in Example 1 were mixed, so that a developer was prepared. The thus prepared developer was subjected to the same image formation tests as in Example 1. The result was that clear images were obtained even after repeating the copy making process 100,000 times.

The initial charge quantity of the toner was +19 μC/g, and the charge quantity after repeating the copy making process 100,000 times was +17 μC/g, which was almost the same as the initial charge quantity.

An observation by an electron microscopy of the carrier particles after repeating the copy making process 100,000 times indicated that there was no peeling of the overcoat layer from the core particles.

The thickness of the overcoat layer of the above coated carrier particles was compared with the thickness of the overcoat layer of the coated carrier particles employed in Example 1 by using cross-sectional electron microscopic photographs of the two overcoat layers. The thickness of the overcoat layer of the carrier particles in Example 1 was 2.5 μm before use, while the thickness was decreased to 1.5 μm after the use of the carrier particles 100,000 times in the image formation tests. In contrast to this, the thickness of the overcoat layer of the carrier particles in Example 14 was 2.2 μm before use, while the thickness was 1.8 μm after the use of the carrier particles 100,000 times in the image formation tests, thus the abrasion of the overcoat layer of the carrier particles in this example was less than that of the overcoat layer of the carrier particles in Example 1.

EXAMPLE 15

[Preparation of Coated Carrier Particles]

A mixture of the following components was mixed and dispersed in a homogenizer at 8000 rpm for 20 minutes, whereby an overcoat layer coating liquid was prepared:

| | Parts by Weight |
|---|---|
| Hexafluoropropene/ethyl vinyl ether/trimethoxy vinyl silane copolymer (weight ratio 64:24:12, number-average molecular weight approx. 8000) | 100 |
| 70% butanol solution of dibutoxy titanium bisoctylene glycolate | 10 |
| Toluene | 800 |
| Boron nitride | 5 |

The above prepared overcoat coating liquid was coated on the surface of spherical iron oxide particles having a particle size of 100 μm in an amount of 5000 parts by weight by use of a fluidized bed coating applicator. The coated overcoating liquid was then heated at 100° C for 2 hours as in Example 1, whereby coated carrier particles were obtained.

100 parts by weight of the above prepared carrier particles and 2.5 parts by weight of the toner particles prepared in Example 1 were mixed, so that a developer was prepared. The thus prepared developer was subjected to the same image formation tests as in Example 1. The result was that clear images were obtained even after repeating the copy making process 100,000 times.

The initial charge quantity of the toner was +16 μC/g, and the charge quantity after repeating the copy making process 100,000 times was +14 μC/g, which was almost the same as the initial charge quantity.

An observation by an electron microscopy of the carrier particles after repeating the copy making process 100,000 times indicated that there was no peeling of the overcoat layer from the core particles.

The thickness of the overcoat layer of the above coated carrier particles was compared with the thickness of the overcoat layer of the coated carrier particles employed in Example 1 by using cross-sectional electron microscopic photographs of the two overcoat layers. The thickness of the overcoat layer of the carrier particles in Example 1 was 2.5 μm before use, while the thickness was decreased to 1.5 μm after the use of the carrier particles 100,000 times in the image formation tests. In contrast to this, the thickness of the overcoat layer of the carrier particles in Example 15 was 2.6 μm before use, while the thickness was 2.0 μm after the use of the carrier particles 100,000 times in the image formation tests, thus the abrasion of the overcoat layer of the carrier particles in this example was less than that of the overcoat layer of the carrier particles in Example 1.

EXAMPLE 16

[Preparation of Coated Carrier Particles]

A mixture of the following components was mixed and dispersed in a homogenizer at 8000 rpm for 20 minutes, whereby an overcoat layer coating liquid was prepared:

| | Parts by Weight |
|---|---|
| Hexafluoropropene/ethyl vinyl ether/trimethoxy vinyl silane copolymer (weight ratio 64:24:12, number-average molecular weight approx. 8000) | 100 |
| 70% butanol solution of dibutoxy titanium bisoctylene glycolate | 10 |
| Toluene | 800 |
| Silicon carbide | 5 |

The above prepared overcoat coating liquid was coated on the surface of spherical iron oxide particles having a particle size of 100 μm in an amount of 5000 parts by weight by use of a fluidized bed coating applicator. The coated overcoating liquid was then heated at 100° C for 2 hours as in Example 1, whereby coated carrier particles were obtained.

100 parts by weight of the above prepared carrier particles and 2.5 parts by weight of the toner particles prepared in Example 1 were mixed, so that a developer was prepared. The thus prepared developer was subjected to the same image formation tests as in Example 1. The result was that clear images were obtained even after repeating the copy making process 100,000 times.

The initial charge quantity of the toner was +18 μC/g, and the charge quantity after repeating the copy making process 100,000 times was +16 μC/g, which was almost the same as the initial charge quantity.

An observation by an electron microscopy of the carrier particles after repeating the copy making process 100,000 times indicated that there was no peeling of the overcoat layer from the core particles.

The thickness of the overcoat layer of the above coated carrier particles was compared with the thickness of the overcoat layer of the coated carrier particles employed in Example 1 by using cross-sectional electron microscopic photographs of the two overcoat layers. The thickness of the overcoat layer of the carrier particles in Example 1 was 2.5 μm before use, while the thickness was decreased to 1.5 μm after the use of the carrier particles 100,000 times in the image formation tests. In contrast to this, the thickness of the overcoat layer of the carrier particles in Example 16 was 2.4 μm before use, while the thickness was 2.0 μm after the use or the carrier particles 100,000 times in the image formation tests, thus the abrasion of the overcoat layer of the carrier particles in this example was less than that of the overcoat layer of the carrier particles in Example 1.

EXAMPLE 17

[Preparation of Coated Toner Transportation Member for Transporting Toner Particles]

A toner transportation member 2 as shown in the accompanying drawing was coated with a 10~20 μm thick overcoat layer by dipping the member into the overcoat layer coating liquid prepared in Example 1. The thus prepared overcoated toner transportation member 2 was incorporated in a development unit as shown in FIG. 1.

A toner was prepared by sufficiently stirring 100 parts by weight of the toner particles prepared in Example 1 and 3 parts by weight of finely-divided silicon carbide particles having a particle size of 2 μm by use of a speed kneader.

The thus prepared toner was placed in the development unit as shown in FIG. 1 so that a continuous copy making test was carried out. Images with excellent quality were obtained and the quality thereof was maintained even after making 50,000 copies.

The development process will now be explained with reference to the accompanying drawing. As shown in FIG. 1, a toner 6 placed in a toner reservoir 7 is forcibly brought onto a sponge roller 4 by a stirring blade 5 so that the toner 6 is supplied onto the sponge roller 4. As the sponge roller 4 is rotated in the direction of the arrow, the toner 6 fed to the sponge roller 4 is transported onto the toner transportation member 2, where the toner 6 is frictioned, and electrostatically or physically attracted to the toner transportation member 2. As the toner transportation member 2 is rotated in the direction of the arrow, a uniformly thin layer of the toner 6 is formed on the toner transportation member 2 by an elastic blade 3. At the same time, the thin layer of the toner 6 is triboelectrically charged. The toner 6 is then transported onto the surface of a latent electrostatic image bearing member 1 which is situated in contact with or near the toner transportation member 2, so that the latent electrostatic image is developed with the toner 6 to a visible toner image.

In accordance with the following steps, electrostatic images are formed on an organic photoconductor comprising (i) a carrier transport layer (CTL) comprising a hydrazone type charge transport material and polycarbonate and (ii) a carrier generation layer (CGL) comprising a bisazo pigment type carrier generation agent and polyvinyl butyral: The photoconductor is uniformly charged to a negative polarity at −800 V in the dark and the uniformly charged photoconductor is exposed to a light image to form a latent electrostatic image. The thus formed latent electrostatic image is developed with the toner to a visible toner image.

For the measurement of the specific charge quantity (Q/M) of the toner on the toner transportation member, a suction type device is employed. In this device, the toner particles on the toner transportation member is sucked and trapped by a Faraday cage equipped with a filter layer at an outlet side thereof, so that the specific charge quantity of the trapped toner in the Faraday cage is measured. The result of the measurement was that the Q/M of the toner was +8.4 μC/g, and it was confirmed that the toner had a sufficient electrostatic charge.

The charge quantity of the toner after making 50,000 copies was +7.2 μC/g, which was almost the same as the initial charge quantity of the toner.

The same excellent image quality as that obtained at a normal humidity was obtained even at high and low humidities.

EXAMPLE 18

[Preparation of Coated Toner Transportation Member for Transporting Toner Particles]

A toner transportation member 2 as shown in the accompanying drawing was coated with a 10~20 μm thick overcoat layer by dipping the member into the overcoat layer coating liquid prepared in Example 1. The thus prepared overcoated toner transportation member 2 was set in a development unit as shown in FIG. 1.

A toner was prepared in accordance with the following formulation:

| | Parts by Weight |
|---|---|
| Styrene - 2-ethyl hexyl acrylate copolymer | 100 |
| Polyethylene | 5 |
| C.I. Pigment Red 57 | 5 |
| C.I. Pigment Red 48 | 5 |

A mixture of the above components was kneaded, pulverized and classified so that a red toner having a particle size of 5~20 μm was obtained.

A toner was prepared by sufficiently mixing 100 parts by weight of the above prepared red toner, 2 parts by weight of silicon carbide having a particle size of 2 μm, and 0.1 part by weight of hydrophobic colloidal silica by using a speed kneader.

The thus prepared toner was placed in the development unit as shown in FIG. 1 and was subjected to the same continuous copy making test as in Example 17. The result was that clear red images with excellent quality were obtained and the quality thereof was maintained even after making 50,000 copies.

The specific charge quantity (Q/M) of the toner on the toner transportation member was measured in the same manner as in Example 17. The result was that the initial Q/M of the toner was +7.6 μC/g, and the Q/M after making 50,000 copies was +6.8 μC/g, indicating that there was no substantial change in the Q/M during the copy making test.

The same excellent image quality as that obtained at a normal humidity was obtained even at high and low humidities.

Example 19

[Preparation of Coated Elastic Blade Member for Formation of Thin Toner Layer]

An elastic blade 3 (made of stainless steel) as shown in the accompanying drawing was coated with a 10~20 μm thick overcoat layer by dipping the elastic blade 3 into the overcoat layer coating liquid prepared in Example 2. The thus prepared overcoated elastic blade 3 was set in a development unit as shown in FIG. 1.

The toner prepared in Example 1 was placed in the development unit as shown in FIG. 1 and was subjected to the same continuous copy making test as in Example 17. The result was that clear images with excellent quality were obtained.

The specific charge quantity (Q/M) of the toner on the toner transportation member was measured in the same manner as in Example 17. The result was that the initial Q/M of the toner was +7.9 μC/g, and the Q/M after making 50,000 copies was +7.6 μC/g, indicating that there was no substantial change in the Q/M during the copy making test.

The same excellent image quality as that obtained at a normal humidity was obtained even at high and low humidities.

EXAMPLE 20

[Preparation of Coated Elastic Blade Member for Formation of Thin Toner Layer]

An elastic blade 3 (made of stainless steel) as shown in the accompanying drawing was coated with a 10~20 μm thick overcoat layer by dipping the elastic blade 3 into the overcoat layer coating liquid prepared in Example 6. The thus prepared overcoated elastic blade 3 was set in a development unit as shown in FIG. 1.

The toner prepared in Example 18 was placed in the development unit as shown in FIG. 1 and was subjected to the same continuous copy making test as in Example 17. The result was that clear images with excellent image quality were obtained.

The specific charge quantity (Q/M) of the toner on the toner transportation member was measured in the same manner as in Example 17. The result was that the initial Q/M of the toner was +7.8 μC/g, and the Q/M after making 50,000 copies was +7.4 μC/g, indicating that there was no substantial change in the Q/M during the copy making test.

The same excellent image quality as that obtained even at a normal humidity was obtained at high and low humidities.

EXAMPLE 21

[Preparation of Coated Elastic Blade Member for Formation of Thin Toner Layer]

A 3 μm thick resin blade molded by heat fusion of hexafluoropropene/ethyl vinyl ether/trimethoxyvinyl silane copolymer (weight ratio 64 : 24 : 12, number average molecular weight. approx. 150,000) was set as an elastic blade 3 as shown in FIG. 1.

A mixture of the following components was kneaded, pulverized, and classified, whereby green toner particles having a particle size of 5~20 μm were prepared:

| | Parts by Weight |
|---|---|
| Epoxy resin | 100 |
| Polypropylene | 5 |
| C.I. Pigment Blue 15 | 2 |
| C.I. Pigment Yellow 17 | 5 |

A toner prepared by sufficiently mixing 100 parts by weight of the above prepared green toner, 2 parts by weight of silicon carbide having a particle size of 2 μm, and 0.1 part by weight of finely-divided zinc stearate particle by using a speed kneader.

The thus prepared toner was placed in the development unit as shown in FIG. 1 and was subjected to the same continuous copy making test as in Example 17. The result was that clear green images with excellent quality were obtained and the quality thereof was maintained even after making 50,000 copies.

The specific charge quantity (Q/M) of the toner on the toner transportation member was measured in the same manner as in Example 17. The result was that the initial Q/M of the toner was +9.5 μC/g, and the Q/M after making 50,000 copies was +8.2 μC/g, thus there was no substantial change in the Q/M during the copy making test.

The same excellent image quality as that obtained even at a normal humidity was obtained at high and low humidities.

EXAMPLE 22

[Preparation of Coated Elastic Blade Member for Formation of Thin Toner Layer]

A 3 μm thick resin blade was molded by heat fusion of chlorotrifluoroethylene/propylvinyl ether/vinyl trimethoxy silane copolymer (weight ratio 55 : 30 : 15, number average molecular weight. approx. 140,000) in the same manner as in Example 21, and the resin blade was set as an elastic blade 3 as shown in FIG. 1.

The toner prepared in Example 18 was placed in the development unit as shown in FIG. 1 and was subjected to the same continuous copy making test as in Example 17. The result was that clear red images with excellent image quality were obtained.

The specific charge quantity (Q/M) of the toner on the toner transportation member was measured in the same manner as in Example 17. The result was that the initial Q/M of the toner was +8.2 μC/g, and the Q/M after making 50,000 copies was +8.0 μC/g, thus there was not substantial change in the Q/M during the copy making test.

The same excellent image quality as that obtained even at a normal humidity was obtained at high and low humidities.

EXAMPLE 23

[Preparation of Coated Elastic Blade Member for Formation of Thin Toner Layer]

A 3 μm thick resin blade molded by heat fusion of a mixture of 100 parts by weight of hexafluoropropene/ethyl vinyl ether/trimethoxyvinyl silane copolymer (weight ratio 64 : 24 : 12, number average molecular weight. approx. 150,000) employed in Example 21 and 30 parts by weight of carbon black was set as an elastic blade 3 as shown in FIG. 1.

A mixture of the following components was kneaded, pulverized and classified, whereby a toner having a particle size of 5~20 μm were prepared:

| | Parts by Weight |
|---|---|
| Styrene - n-butylacrylate | 100 |
| Polyethylene | 5 |
| Carbon black | 5 |
| Charge control agent (quaternary ammonium salt) | 0.5 |

A toner was prepared by sufficiently mixing 100 parts by weight of the above prepared toner, 3 parts by weight of silicon carbide having a particle size of 2 μm, and 0.5 parts by weight of finely-divided titanium oxide particles by using a speed kneader.

The thus prepared toner was placed in the development unit as shown in FIG. 1 and was subjected to the same continuous copy making test as in Example 17. The result was that clear black images with excellent quality were obtained and the quality thereof was maintained even after making 50,000 copies.

The specific charge quantity (Q/M) of the toner on the toner transportation member was measured in the same manner as in Example 17. The result was that the initial Q/M of the toner was +9.3 μC/g, and the Q/M after making 50,000 copies was +8.9 μC/g, thus there was no substantial change in the Q/M during the copy making test.

The same excellent image quality as that obtained at a normal humidity was obtained even at high and low humidities.

EXAMPLE 24

[Preparation of Coated Elastic Blade Member for Formation of Thin Toner Layer]

A 3 μm thick resin blade was molded by heat fusion of a mixture of 100 parts by weight of chlorotrifluoroethylene/propylvinyl ether/vinyl trimethoxy silane copolymer (weight ratio 55 : 30 : 15, number average molecular weight. approx. 140,000) prepared in Example 22 and 30 parts by weight of calcium carbonate and was set as an elastic blade 3 as shown in FIG. 1.

The toner prepared in Example 18 was placed in the development unit as shown in FIG. 1 and was subjected to the same continuous copy making test as in Example 17. The result was that clear red images with excellent image quality were obtained.

The specific charge quantity (Q/M) of the toner on the toner transportation member was measured in the same manner as in Example 17. The result was that the initial Q/M of the toner was +7.9 μC/g, and the Q/M after making 50,000 copies was +7.6 μC/g, thus there was no substantial change in the Q/M during the copy making test.

The same excellent image quality as that obtained even at a normal humidity was obtained at high and low humidities.

EXAMPLE 25

[Preparation of Coated Elastic Blade Member for Formation of Thin Toner Layer]

A 3 μm thick resin blade was molded in the same manner as in Example 21 by heat fusion of a mixture of 100 parts by weight of hexafluoropropene/ethyl vinyl ether/trimethoxy vinyl silane copolymer (weight ratio 64 : 24 : 12, number average molecular weight. approx. 150,000) prepared in Example 21 and 30 parts by weight of glass fiber and was wet as an elastic blade 3 as shown in FIG. 1.

A mixture of the following components was kneaded, pulverized, and classified, whereby a toner having a particle size of 5~20 μm were prepared:

| | Parts by Weight |
|---|---|
| Styrene - 2-ethyl hexyl acrylate copolymer | 100 |
| Polypropylene | 5 |
| Carbon black | 7 |
| Charge controlling agent (Nigrosine dye) | 0.3 |

A toner was prepared by sufficiently mixing 100 parts by weight of the above prepared toner, 3 parts by weight of silicon carbide having a particle size of 2 μm, and 0.5 parts by weight of finely-divided titanium oxide particles by using a speed kneader.

The thus prepared toner was placed in the development unit as shown in FIG. 1 and was subjected to the same continuous copy making test as in Example 17. The result was that clear black images with excellent quality were obtained and the quality thereof was maintained even after making 50,000 copies.

The specific charge quantity (Q/M) of the toner on the toner transportation member was measured in the same manner as in Example 17. The result was that the initial Q/M of the toner was +8.2 μC/g, and the Q/M after making 50,000 copies was +7.9 μC/g, thus there was no substantial change in the Q/M during the copy making test.

The same excellent image quality as that obtained even at a normal humidity was obtained at high and low humidities.

EXAMPLE 26

[Preparation of Coated Elastic Blade Member for Formation of Thin Toner Layer]

A 3 μm thick resin blade was molded in the same manner as in Example 21 by heat fusion of a mixture of 100 parts by weight of hexafluoropropene/ethyl vinyl ether/trimethoxy vinyl silane copolymer (weight ratio 64 : 24 : 12, number average molecular weight. approx. 150,000) prepared in Example 21 and 30 parts by weight of finely-divided silica particles and was set as an elastic blade 3 as shown in FIG. 1.

A mixture of the following components was kneaded, pulverized, and classified, whereby a toner having a particle size of 5~20 μm were prepared:

| | Parts by Weight |
|---|---|
| Styrene - n-butyl acrylate copolymer | 100 |
| Polypropylene | 5 |
| C.I. Pigment Yellow 17 | 5 |
| Charge controlling agent (quaternary ammonium salt) | 0.2 |

A toner was prepared by sufficiently mixing 100 parts by weight of the above prepared toner, 3 parts by weight of silicon carbide having a particle size of 3 μm, and 0.3 parts by weight of finely-divided allumina particles by using a speed kneader.

The thus prepared toner was placed in the development unit as shown in FIG. 1 and was subjected to the same continuous copy making test as in Example 17. The result was that clear yellow images with excellent quality were obtained and the quality thereof was maintained even after making 50,000 copies.

The specific charge quantity (Q/M) of the toner on the toner transportation member was measured in the same manner as in Example 17. The result was that the initial Q/M of the toner was +9.4 μC/g, and the Q/M after making 50,000 copies was +9.0 μC/g, thus there was no substantial change in the Q/M during the copy making test.

The same excellent image quality as that obtained even at a normal humidity was obtained at high and low humidities.

EXAMPLE 27

[Preparation of Coated Toner Transportation Member for Transporting Toner Particles]

A toner transportation member 2 as shown in FIG. 1 was coated with the overcoat layer coating liquid employed in Example 13 by spray coating with a thickness of 10 to 20 μm and was set in the development unit.

The toner prepared in Example 1 was placed in the development unit as shown in FIG. 1 and was subjected to the same continuous copy making test as in Example 17. The result was that clear images with excellent image quality were obtained.

The specific charge quantity (Q/M) of the tone on the toner transportation member was measured in the same manner as in Example 17. The result was that the initial Q/M of the toner was +7.4 μC/g, and the Q/M after making 50,000 copies was +6.8 μC/g, thus there was not substantial change in the Q/M during the copy making test.

The same excellent image quality as that obtained even at a normal humidity was obtained at high and low humidities.

EXAMPLE 28

[Preparation of Coated Toner Transportation Member for Transporting Toner Particles]

A toner transportation member 2 as shown in FIG. 1 was coated with the overcoat layer coating liquid employed in Example 21 by spray coating with a thickness of 10 to 20 μm and was set in the development unit.

The toner prepared in Example 1 was placed in the development unit as shown in FIG. 1 and was subjected to the same continuous copy making test as in Example 17. The result was that clear images with excellent image quality were obtained.

The specific charge quantity (Q/M) of the toner on the toner transportation member was measured in the same manner as in Example 17. The result was that the initial Q/M of the toner was +6.9 μC/g, and the Q/M after making 50,000 copies was +6.2 μC/g, thus there was no substantial change in the Q/M during the copy making test.

The same excellent image quality as that obtained even at a normal humidity was obtained at high and low humidities.

EXAMPLE 29

[Preparation of Coated Toner Transportation Member for Transporting Toner Particles]

A toner transportation member 2 as shown in FIG. 1 was coated with the overcoat layer coating liquid employed in Exmaple 15 by spray coating with a thickness of 10 to 20 μm and was set in the development unit.

The toner prepared in Example 1 was placed in the development unit as shown in FIG. 1 and was subjected to the same continuous copy making test as in Example 17. The result was that clear images with excellent image quality were obtained.

The specific charge quantity (Q/M) of the toner on the toner transportation member was measured in the same manner as in Example 17. The result was that the initial Q/M of the toner was +7.8μC/g, and the Q/M after making 50,000 copies was +6.9 μC/g, thus there was no substantial change in the Q/M during the copy making test.

The same excellent image quality as that obtained even at a normal humidity was obtained at high and low humidities.

EXAMPLE 30

[Preparation of Coated Toner Transportation Member for Transporting Toner Particles]

A toner transportation member 2 as shown in FIG. 1 was coated with the overcoat layer coating liquid employed in Example 16 by spray coating with a thickness of 10 to 20 μm and was set in the development unit.

The toner prepared in Example 1 was placed in the development unit as shown in FIG. 1 and was subjected to the same continuous copy making test as in Example 17. The result was that clear images with excellent image quality were obtained.

The specific charge quantity (Q/M) of the toner on the toner transportation member was measured in the same manner as in Example 17. The result was that the initial Q/M of the toner was +7.8 μC/g, and the Q/M after making 50,000 copies was +6.5 μC/g, thus there was no substantial change in the Q/M during the copy making test.

The same excellent image quality as that obtained even at a normal humidity was obtained at high and low humidities.

As mentioned above, the triobelectric charge application member according to the present invention does not have such defects that a film of a toner film is formed on the surface of the triboelectric charge application member, and an overcoat layer is peeled off the triboelectric charge application member. Furthermore, according to the present invention, excellent image quality can be maintained from the initial stage of making copies through a continuous copy making process for an extended period of time, without any substantial changes in the charge quantity thereof, without being effected by the changes in the ambient conditions, either at high humidities and high temperatures.

What is claimed is:

1. A triboelectric charge application member for triboelectrically charging toner comprising a base substrate member and an overcoat layer formed thereon which layer comprises as the main component as copolymer prepared from at least one fluoro-olefin monomer and an unsaturated organosilane monomer.

2. The triboelectic charge application member as claimed in claim 1, wherein said copolymer further comprises units of a vinylether monomer.

3. The triboelectric charge application member as claimed in claim 1, wherein said fluoro-olefin monomer is a fluoro-olefin compound having 2 or 3 carbon atoms.

4. The triboelectric charge application member as claimed in claim 1, wherein said fluoro-olefin monomer is selected from the group consisting of tetrafluoroethylene ($CF_2=CF_2$), chlorotrifluoroethylene ($CFCl=CF_2$) and hexafluoropropene ($CF_2=CFCF_3$).

5. The triboelectric charge application member as claimed in claim 1, wherein said unsaturated organosilane monomer contains at least one group having an olefinically unsaturated bond and also contains a hydrolyzable group.

6. The triboelectric charge application member as claimed in claim 1, wherein said copolymer is prepared from said fluoro-olefin monomer, a vinyl ether monomer, and said organosilane monomer which contains at least one group having an ethylenically unsaturated bond and also contains a hydrolyzable group, with the mole ratios of said fluoro-olefin monomer, said vinyl ether monomer and said organosilane monomer, respectively, being 30 to 70 mole %, 20 to 60 mole %, and 1 to 25%, based on the total moles of said fluoro-olefin monomer, said vinylether monomer and said organosilane monomer, said copolymer having a number average molecular weight (Mn) of 3,000 to 200,000, as measured by gel permeation chromatography.

7. The triboelectric charge application member as claimed in claim 2, wherein said vinyl ether compound is an alkyl vinyl ether bonded to alkyl groups having 2 to 4 carbon atoms.

8. The triboelectric charge application member as claimed in claim 2, wherein said vinyl ether compound is selected from the group consisting of ethyl vinyl ether, propyl vinyl ether and butyl vinyl ether.

9. The triboelectric charge application member as claimed in claim 5, wherein said organosilane monomer is selected from the group consisting of the compounds having the following general formulas (1) through (3):

$$R^1R^2SiY^1Y^2 \quad (1)$$

$$R^1XSiY^1Y^2 \quad (2)$$

$$R^1SiY^1Y^2Y^3 \quad (3)$$

wherein $R^1$ and $R^2$ each represent a group including an ethylenically unsaturated bond, and consisting of carbon atoms, hydrogen atoms and, optionally, oxygen atoms, and $R^1$ and $R^2$ may be the same or different; X represents an organic group having no ethylenically unsaturated bond, and $Y^1$, $Y^2$ and $Y^3$ each represent a hydrolyzable group, which may be the same or different.

10. The triboelectric charge application member as claimed in claim 5, wherein said organosilane monomer is selected from the group consisting of vinyloxy propyl trimethoxy silane, vinyl trimethoxy silane; vinyl triethoxy silane, vinyl tris(methoxy ethoxy) silane, vinyl menthyl diethoxy silane, and vinyl phenyl dimethoxy silane.

11. The triboelectric charge application member as claimed in claim 1, wherein said overcoat layer further comprises one component selected from the group consisting of silicon oxide, aluminum oxide, titanium oxide, tin oxide, antimony oxide, carbon black, boron nitride, titanium black, silicon carbide, and boron carbide.

12. A triboelectric charge application member in the form of carrier particles for triboelectrically charging toner, each carrier particle comprising a core particle and an overcoat layer formed on the surface of said core particle, which overcoat layer comprises as the main component a copolymer prepared from at least one fluoro-olefin monomer and an unsaturated organosilane monomer.

13. The triboelectric charge application member as claimed in claim 12, wherein said copolymer further comprises a vinyl ether monomer.

14. The triboelectric charge application member as claimed in claim 12, wherein said fluoro-olefin monomer is a fluoro-olefin compound having 2 or 3 carbon atoms.

15. The triboelectric charge application member as claimed in claim 12, wherein said fluoro-olefin monomer is selected from the group consisting of tetrafluoroethylene ($CF_2=CF_2$), chlorotrifluoroethylene ($CFCl=CF_2$) and hexafluoropropene ($CF_2=CFCF_3$).

16. The triboelectic charge application member as claimed in claim 12, wherein said unsaturated organosilane contains at least one group having an ethylenically unsaturated bond and also contains a hydrolyzable group.

17. The triboelectric charge application member as claimed in claim 12, wherein said copolymer is prepared from said fluoro-olefin monomer, a vinyl ether monomer, and said organosilane monomer which contains at least one group having an ethylenically unsaturated bond and also contains a hydrolyzable group, with the mole ratios of said fluoro-olefin monomer, said vinyl ether monomer and said organosilane monomer, respectively, being 30 to 70 mole %, 20 to 60 mole % and 1 to 25%, based on the total moles of said fluoro-olefin monomer, said vinylether monomer and said organosilane monomer, said copolymer having a number average molecular weight (Mn) of 3,000 to 200,000, as measured by gel permeation chromatography.

18. The triboelectric charge application member as claimed in claim 13, wherein said vinyl ether compound is an alkyl vinyl ether bonded to alkyl groups having 2 to 4 carbon atoms.

19. The triboelectric charge application member as claimed in claim 13, wherein said vinylether compound is selected from the group consisting of ethyl vinyl ether, propyl vinyl ether and butyl vinyl ether.

20. The triboelectric charge application member as claimed in claim 16, wherein said organosilane monomer is selected from the group consisting of the compounds having the following general formulas (1) through (3):

$$R^1R^2SiY^1Y^2 \quad (1)$$

$$R^1XSiY^1Y^2 \quad (2)$$

$$R^1SiY^1Y^2Y^3 \quad (3)$$

wherein $R^1$ and $R^2$ each represent a group including an ethylenically unsaturated bond and consisting of carbon atoms, hydrogen atoms and, optionally, oxygen atoms, and $R^1$ and $R^2$ may be the same or different; X represents an organic group having no ethylenically unsaturated bond, and $Y^1$, $Y^2$ and $Y^3$ each represent a hydrolyzable group, which may be the same or different.

21. The triboelectric charge application member as claimed in claim 16, wherein said organic silicon monomer is selected from the group consisting cf vinyloxy propyl trimethoxy silane, vinyl trimethoxy silane, vinyl triethoxy silane, vinyl tris(methoxy ethoxy) silane, vinyl methyl diethoxy silane, and vinyl phenyl dimethoxy silane.

22. The triboelectric charge application member as claimed in claim 12, wherein said overcoat layer further comprises one component selected from the group consisting of silicon oxide, aluminum oxide, titanium oxide, tin oxide, antimony oxide, carbon black, boron nitride, titanium black, silicon carbide, and boron carbide.

* * * * *

UNITED STATES PATENT AND TRADEMARK OFFICE

CERTIFICATE OF CORRECTION

PATENT NO. : 4 945 022

DATED : July 31, 1990

INVENTOR(S) : Nobuhiro NAKAYAMA et al

It is certified that error appears in the above-identified patent and that said Letters Patent is hereby corrected as shown below:

Column 26, line 60; change "as" (second occurrence) to ---a---.

Column 27, line 20; change "vinylether" to ---vinyl ether---.

line 39; change "$R^1SiY^1Y^2Y^3$(3) to ---$R^1SiY^1Y^2Y^3$ (3)---.

Column 28, line 27; change "vinylether" to ---vinyl ether---.

line 35; change "vinylether" to ---vinyl ether---.

Signed and Sealed this

Twenty-first Day of April, 1992

*Attest:*

HARRY F. MANBECK, JR.

*Attesting Officer*

*Commissioner of Patents and Trademarks*